United States Patent [19]

Freermann

[11] 4,448,138

[45] May 15, 1984

[54] MACHINE FOR CONTINUOUSLY FOLDING OVER AND STITCHING WEB EDGES

[75] Inventor: Johannes Freermann, Ochtrup, Fed. Rep. of Germany

[73] Assignee: Carl Schmale KG, Ochtrup, Fed. Rep. of Germany

[21] Appl. No.: 507,868

[22] Filed: Jun. 24, 1983

[30] Foreign Application Priority Data

Jul. 21, 1982 [DE] Fed. Rep. of Germany ..... 3227196

[51] Int. Cl.[3] ..... D05B 35/00

[52] U.S. Cl. ..... 112/147; 112/153; 112/121.14

[58] Field of Search ..... 112/147, 153, 152, 136, 112/121.14, 150, 141, 148

[56] References Cited

U.S. PATENT DOCUMENTS

| | | | |
|---|---|---|---|
| 2,546,831 | 3/1951 | Newell | 112/147 X |
| 3,012,603 | 12/1961 | Newsone et al. | 112/147 X |
| 3,463,482 | 8/1969 | Baron et al. | 112/147 X |

FOREIGN PATENT DOCUMENTS

| | | | |
|---|---|---|---|
| 2509506 | 9/1976 | Fed. Rep. of Germany | 112/153 |

*Primary Examiner*—H. Hampton Hunter

*Attorney, Agent, or Firm*—Karl F. Ross; Herbert Dubno

[57] ABSTRACT

An apparatus for folding over and stitching the longitudinally extending and transversely spaced edges of an elongated textile web has a pair of longitudinally spaced and transversely throughgoing main rolls rotatable about respective parallel axes and operated by guide and drive means that pass the web longitudinally and continuously from one of the main rolls to the other main roll in a travel direction perpendicular to the roll axes and with the web spanned tightly longitudinally between the main rolls and lying generally in a plane with its edges generally parallel. Respective stretchers transversely confronting each other between the main rolls engage the web edges for urging same transversely apart and thereby transversely stretching the web. Folders between the stretchers and the downstream main roll fold over the edges of the web and sewing devices between the folding means and the downstream main roll stitch together the folded-over web edges. The stretchers each include a plurality of rails inclined in the transport direction away from the other edge and normally frictionally engaging the goods. The rails of one edge diverge downstream from the rails of the other edge. In addition each of the stretchers has a pair of parts at least one of which is urged toward the other so that the edges of the web are gripped by the respective pair of stretcher parts.

14 Claims, 4 Drawing Figures

MACHINE FOR CONTINUOUSLY FOLDING OVER AND STITCHING WEB EDGES

FIELD OF THE INVENTION

The present invention relates to a method of and machine for continuously folding over and stitching the longitudinal edges of a textile web. More particularly this invention concerns the selvedging of terry towels.

BACKGROUND OF THE INVENTION

A machine is known from German patent document 2,509,506 that conveys a textile web workpiece longitudinally, that is parallel to its warp, along a stretch or path between a pair of longitudinally spaced and transversely throughgoing main rolls rotatable about respective parallel axes. A guide and drive system moves the web longitudinally from one of the main rolls to the other in a travel direction perpendicular to the roll axes and with the web spanned tightly longitudinally between the main rolls and lying generally in a plane. The edges of the web are folded over by respective devices between the stretchers and the downstream main roll and then the folded-over edges are stitched longitudinally to stabilize them.

The web must be relatively tight so it can be accurately selvedged in such a machine. It is therefore standard practice to rotate the downstream main roller, and any other drive means downstream therefrom, at a peripheral speed greater than that of the upstream main roller and any other drive means upstream therefrom. This action tensions the web longitudinally.

Unfortunately with such a system it is frequent that the fabric bellies down where it hangs between the two main drive rollers, which are usually horizontally spaced from each other. This tends to pull in the transverse edges, making accurate selvedging difficult. In addition it leaves the edges shorter than the middle of the goods, measured parallel to the warp, when the goods are released. The resultant workpiece therefore curls up at the ends.

When this problem appears in the production, for example, of towels of terrycloth from goods which have loopfree transverse stripes that are to be positioned adjacent the short ends of the towels when they are cut from the selvedged web, it becomes particularly difficult to make an attractive product. When the tension is wrong the loopfree stripes do no extend parallel to the ends, making the towels into seconds.

OBJECTS OF THE INVENTION

It is therefore an object of the present invention to provide an improved method of and apparatus for selvedging a textile web.

Another object is the provision of such a method of and apparatus for selvedging a textile web which overcome the above-given disadvantages, that is which ensure accurate and continuous selvedging even when operating at high speed.

A yet further object is to provide an improved method of and apparatus for selvedging transversely banded terrycloth.

SUMMARY OF THE INVENTION

An apparatus for folding over and stitching the longitudinally extending and transversely spaced edges of an elongated textile web according to the invention has a pair of longitudinally spaced and transversely throughgoing main rolls rotatable about respective parallel axes and operated by guide and drive means that pass the web longitudinally and continuously from one of the main rolls to the other main roll in a travel direction perpendicular to the roll axes and with the web spanned tightly longitudinally between the main rolls and lying generally in a plane with its edges generally parallel. Respective stretchers transversely confronting each other between the main rolls engage the web edges for urging same transversely apart and thereby transversely stretching the web. Folders between the stretchers and the downstream main roll fold over the edges of the web and sewing devices between the folding means and the downstream main roll stitch together the folded-over web edges.

In this manner in the working region between the main rolls the workpiece, here a textile web, is elastically stretched somewhat both longitudinally and transversely, normally to the same extent in both directions. As a result any transverse weft pattern will remain perfectly aligned, and the edges of the goods will not fold and move transversely.

The stretchers according to this invention each include a plurality of rails inclined in the transport direction away from the other edge and normally frictionally engaging the goods. The rails of one edge diverge downstream from the rails of the other edge. In addition each of the stretchers has a pair of parts at least one of which is urged toward the other so that the edges of the web are gripped by the respective pair of stretcher parts. These rails are provided on a face of at least one of the stretcher parts and each stretcher has means for rotating at least its one part provided with the rails about an axis generally perpendicular to the web between the main rolls for varying the angular orientation of the respective rails relative to the travel direction and thereby varying the transverse-stretching effect.

Each stretcher according to the invention is provided with spring means of variable force for urging its movable part toward the other part with a variable spring force. Increasing the spring force to engage the workpiece more tightly will normally increase the transverse-stretching effect and vice versa.

According to this invention a sensor is provided inside the folding means for determining the transverse position of the edges of the web and is connected to servo means for adjusting the positions of the sewing means in accordance with the detected position to keep the stitchers aligned with the respective edges.

The guide and drive means according to this invention includes respective pairs of pinch rollers downstream of the sewing means and upstream of the downstream main roller gripping the web edges, and motor means for rotating at least one of the pinch rollers of each pair. Such construction insures that the web will be positively engaged at its region of least longitudinal stretch so as accruately to pull the goods through the stitchers.

The selvedging method according to this invention therefore comprise the steps of passing the web longitudinally and continuously from a transversely throughgoing upstream main roll to a transversely throughgoing downstream main roll in a travel direction perpendicular to the rolls and with the web spanned tightly longitudinally between the main rollers and lying generally in a plane with its edges generally parallel while engaging the web edges at a stretching location between the main rolls to transversely urge the edges transversely apart and stretch the web. The edges of the web are folded over and then stitched together between the stretching location and the downstream roll.

DESCRIPTION OF THE DRAWING

The above and other features and advantages will become more readily apparent from the following, reference being made to the accompanying drawing in which.

SPECIFIC DESCRIPTION

Figure 1:
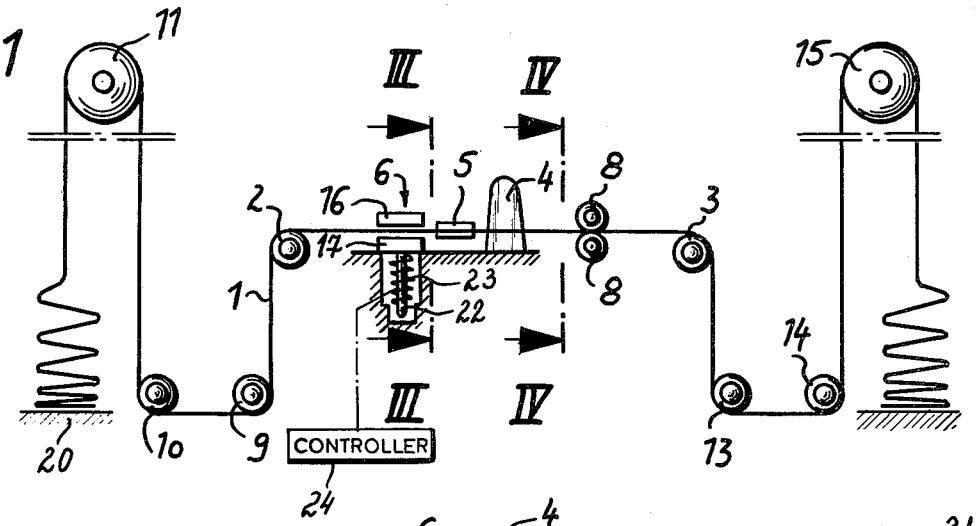
FIG. 1 is a side view of the apparatus of this invention.

As seen in the drawing a terrycloth web 1 is spanned between horizontal and transversely throughgoing main rolls 2 and 3 so as to lie between these rolls 2 and 3 in a horizontal plane above and parallel to their axes which themselves are parallel and horizontal. In this working stretch defined by the rolls 2 and 3 the web edges are first pulled transversely apart by transverse stretchers 6, then folded over by folders 5, and then sewn by stitchers 4. The web 2 is not centrally supported between the rolls 2 and 3, however. The devices 4 and 5 are well known in the art and need no specific discussion here.

Figure 2:
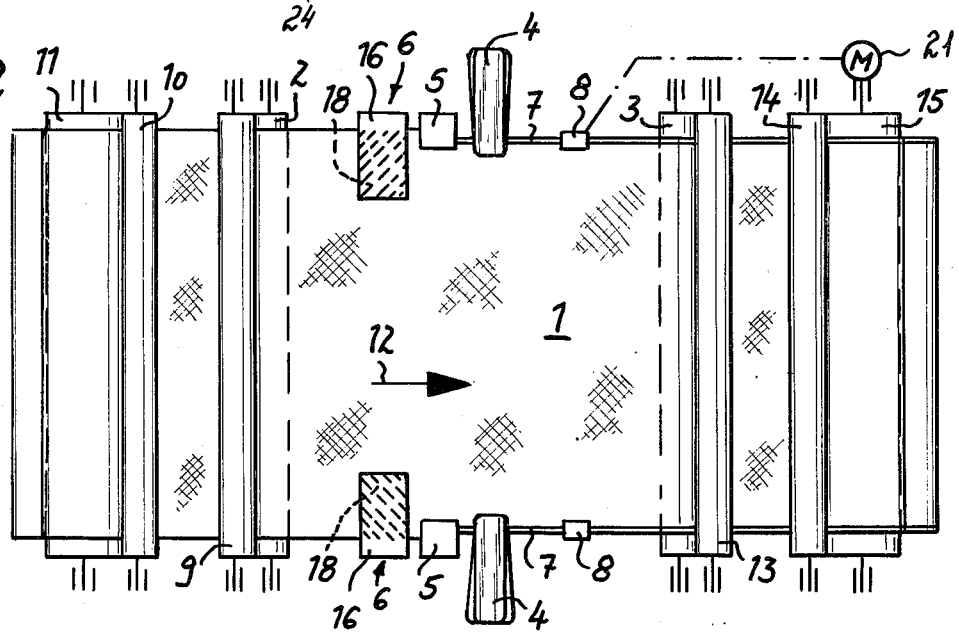
FIG. 2 is a top view of the apparatus of FIG. 1.
Figure 4:
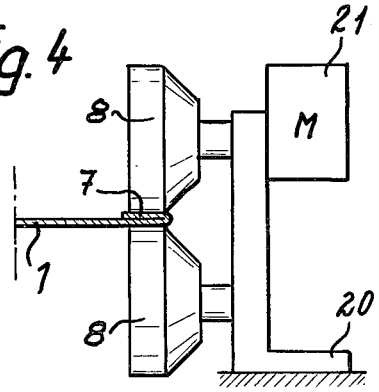

Upstream of the upstream main roller 2 the web 1 starts out folded up on a stationary support 20, then passes up and over an upstream drive roller 11, then down and under two further rolls 9 and 10, to rise up to the upstream main roll 2. A drive including a motor illustrated at 21 in FIGS. 2 and 4 is connected to these rolls 2, 9, 10, and 11 to rotate them at the same relatively slow peripheral speed. Similarly downstream from the downstream main roll 3 the web 1 passes under two small deflecting rolls 13 and 14, then up over another roll 15 to be deposited in a folded pile. These rolls 3, 13, 14, and 15 are driven at the same relatively fast transport speed to move the web 1 in the direction 12 and tension it longitudinally. It is also simply possible to brake the upstream drive rolls 2, 9, 10, and 11 slightly to longitudinally tension the web 2.

The stretchers 6 each include a stationary upper jaw or part 16 and a vertically displaceable lower jaw or part 17. At least this latter part 17 is formed with a plurality of ridges or rails 18 that are inclined as shown in dot-dash lines in FIG. 2 relative to the transport direction 12. To this end the part 17 is carried on a shaft 22 defining a vertical axis and both vertically displaceable and rotatable about this axis in a stationary support 20. A spring 23 whose force can be adjusted, for example by moving an abutment it bears against, can vary the force with which the part 17 is pushed upward against the part 16. In addition a controller and servo system 24 is attached to both of the shafts 22 to rotate the parts 17 about the respective vertical axes to vary the extent of transverse stretching. As the angle the rails 18 forms to the direction 12 increases, so does the transverse stretching effect. Similarly increasing the spring force also increases this effect. The jaw or part 16 can be identically mounted and controlled.

Figure 3:
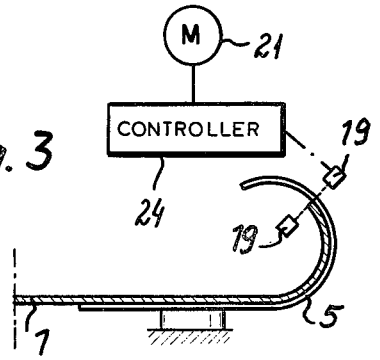
FIGS. 3 and 4 are cross sections taken respectively along lines III—III and IV—IV of FIG. 1.

As shown in FIG. 3 each folding device 5, which is formed basically as a C-section rail, is provided with photocell position detectors 19 also connected to the controller 24 which in turn is connected to the drive 21 and to various motor s for transversely positioning the stitchers 4. When the edges of the web move in, the stitchers 4 move in, and then the edges move out the stitchers 4 move out. Thus as the webs advance the folders 5 form a folded over selvedge 7 that is stitched together by the sewing devices 4.

Immediately downstream of each of the stitchers 4 is a pair of pinch rollers 8 that tightly vertically pinch the stitched edge 7 and that are driven by the drive 21 at the stitching speed, which is also the peripheral speed of the rolls 3, 13, 14, and 15. This drive-roll arrangement 8 therefore ensures perfectly smooth advance of the web in the direction 12 through the device. The vertical space between the pinch rolls 8 can be adjusted to compensate for different thicknesses of the web 2 and furthermore the roll surfaces are roughened, for example by milling or knurling, to enhance thr grip on the web 2.

With the system according to this invention, therefore, the goods will be evenly tensioned in both directions so the selvedges will not pucker when released. The goods will lie flat after thus selvedged.

I claim:

1. An apparatus for folding over and stitching the longitudinally extending and transversely spaced edges of an elongated textile web, the apparatus comprising:

a pair of longitudinally spaced and transversely throughgoing main rolls rotatable about respective parallel axes;

guide and drive means for passing the web longitudinally and continuously from one of the main rolls to the other main roll in a travel direction perpendicular to the roll axes and with the web spanned tightly longitudinally between the main rolls and lying generally in a plane with its edges generally parallel;

means including respective stretchers transversely confronting each other between the main rolls and engaging the web edges for urging same transversely apart and thereby transversely stretching the web;

means between the stretchers and the downstream main roll for folding over the edges of the web; and sewing means between the folding means and the downstream main roll for stitching together for folded-over web edges.

2. The apparatus defined in claim 1 wherein the stretchers of each edge include a plurality of rails inclined in the transport direction away from the other edge, whereby the rails of one edge diverge downstream from the rails of the other edge.

3. The apparatus defined in claim 1 wherein each of the stretchers has a pair of parts at least one of which is urged toward the other, whereby the edges of the web are gripped by the respective pair of stretcher parts.

4. The apparatus defined in claim 3 wherein at least one of the stretcher parts of each pair has a face turned toward the web and provided with the respective rails.

5. The apparatus defined in claim 4 wherein each stretcher is provided with means for rotating at least its one part provided with the rails about an axis generally perpendicular to the web between the main rolls for varying the angular orientation of the respective rails relative to the travel direction and thereby varying the transverse-stretching effect.

6. The apparatus defined in claim 3 wherein each stretcher is provided with spring means of variable force for urging its movable part toward the other part with a variable spring force.

7. The apparatus defined in claim 1, further comprising sensor means inside the following means for determining the transverse position of the edges of the web; and servo means for adjusting the positions of the sewing means to keep same aligned with the respective edges.

8. The apparatus defined in claim 1 wherein the guide and drive means includes respective pairs of pinch rollers downstream of the sewing means and upstream of the downstream main roller gripping the web edges, and motor means for rotating at least one of the pinch rollers of each pair.

9. A method of selvedging the longitudinally extending and transversely spaced edges of an elongated textile web, the method comprising the steps of:

passing the web longitudinally and continuously from a transversely throughgoing upstream main roll to a transversely throughgoing downstream main roll in a travel direction perpendicular to the rolls and with the web spanned tightly longitudinally between the main rolls and lying generally in a plane with its edges generally parallel;

engaging the web edges at a stretching location between the main rolls to urge the edges transversely apart and transversely stretch the web;

folding over the edges of the web between the stretching location and the downstream roll; and stitching together the folded-over web edges upstream of the downstream main roll.

10. The method defined in claim 9 wherein the webs edges are engaged for transverse stretching of the web by respective stretchers each including:

a pair of parts confronting each other at the respective web edge; and rails formed on at least one of the parts of each pair and diverging downstream away from the other web edge, the method further comprising the step of urging the parts of each pair toward each other, whereby the rails urge the respective edges transversely away from each other.

11. The method defined in claim 10, further comprising the step of rotating at least the one part provided with the rails of each stretcher pair about an axis generally perpendicular to the web between the main rolls for varying the angular orientation of the respective rails relative to the travel direction and thereby varying the transverse-stretching effect.

12. The method defined in claim 10, further comprising the step of varying the force with which the parts of the stretcher pair are urged toward each other and thereby varying the transverse-stretching effect.

13. The method defined in claim 9, further comprising the step of detecting at the folding location the transverse position of the edges of the web; and adjusting the positions of the sewing means in accordance with edge positions to keep it aligned with the respective edges.

14. The method defined in claim 9 wherein the web is advanced from the upstream main roller to the downstream roller by pinching the web edges downstream of the sewing location and upstream of the downstream main roller by respective pairs of pinch rollers and rotating at least one of the pinch rollers of each pair.

* * * * *